United States Patent [19]

Andrews

[11] Patent Number: 5,048,144

[45] Date of Patent: Sep. 17, 1991

[54] REMOVABLE COVER SYSTEM FOR TOOTHBRUSHES

[76] Inventor: Edward A. Andrews, 1475 Ravine View Ct., Bloomfield Hills, Mich. 48013

[21] Appl. No.: 586,565

[22] Filed: Sep. 21, 1990

[51] Int. Cl.[5] ..... A46B 9/04; A46B 17/04

[52] U.S. Cl. ..... 15/184; 15/167.1

[58] Field of Search ..... 15/184, 167.1; 401/202, 401/213, 269, 98

[56] References Cited

U.S. PATENT DOCUMENTS

| | | | |
|---|---|---|---|
| 919,440 | 4/1909 | Lawson et al. | 15/184 |
| 2,695,416 | 11/1954 | Raimo | 15/184 |
| 2,947,412 | 8/1960 | Tupper | 15/184 |
| 3,280,417 | 10/1966 | Wexler | 15/184 |

FOREIGN PATENT DOCUMENTS

| | | | |
|---|---|---|---|
| 143105 | 3/1902 | Fed. Rep. of Germany | 15/184 |
| 21288 | of 1905 | United Kingdom | 15/184 |
| 811195 | 4/1959 | United Kingdom | 15/184 |

*Primary Examiner*—Harvey C. Hornsby
*Assistant Examiner*—Terrence R. Till
*Attorney, Agent, or Firm*—Harness, Dickey & Pierce

[57] ABSTRACT

A thin wall, U-shaped in cross-section, elongated cover is shaped to fit over the bristles and the bristle end of a toothbrush for covering and protecting the bristles. The free ends of the legs defining the U-shape of the cover, are provided with engaging formations for frictionally engaging the sides of the bristle carrying portion of the brush handle. The cover is formed of a springy plastic material so that the bristle carrying portion is resiliently clamped between the engaging formations of the legs. Thus, the cover may be manually applied upon and removed from the brush and will be tightly held upon the brush by the springy clamping action and the frictional engagement of the cover legs.

7 Claims, 1 Drawing Sheet

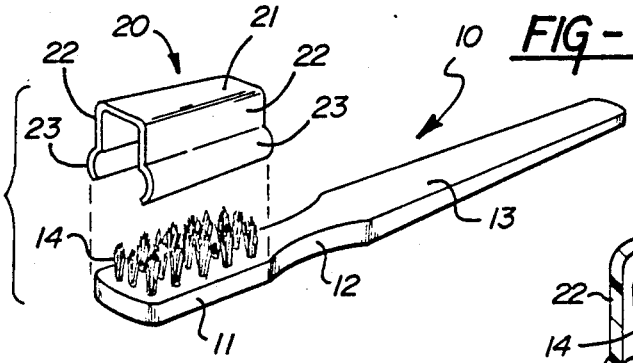
FIG - 1
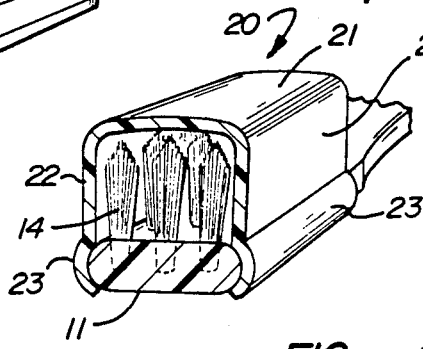
FIG - 2
FIG - 3
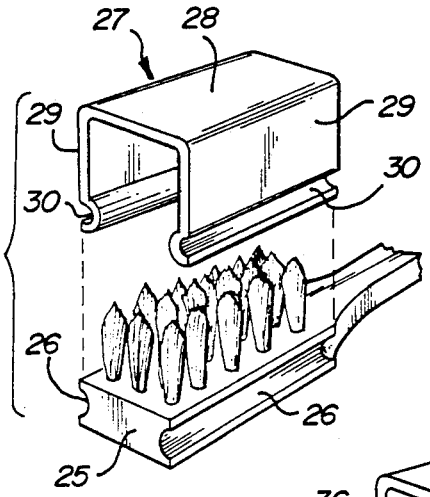
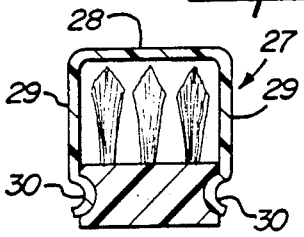
FIG - 4
FIG - 5
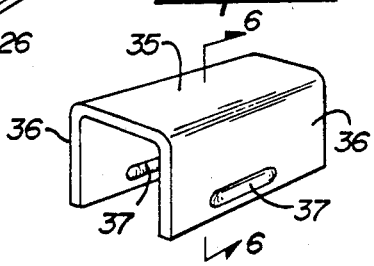
FIG - 6
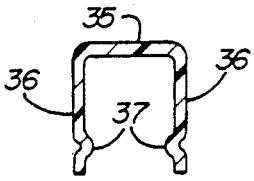
FIG - 7
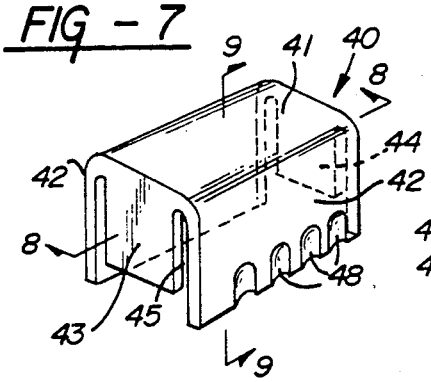
FIG - 8
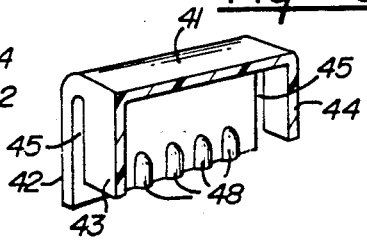
FIG - 9
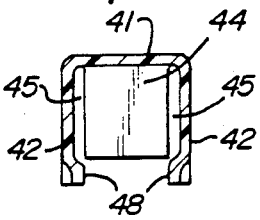
FIG - 10
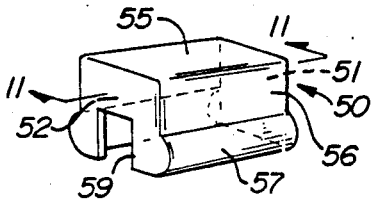
FIG - 11
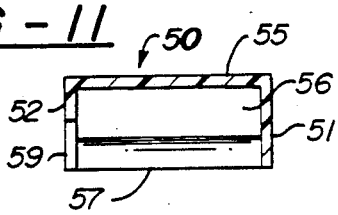

REMOVABLE COVER SYSTEM FOR TOOTHBRUSHES

BACKGROUND OF INVENTION

Conventional toothbrushes are formed with an elongated handle, one end of which forms a bristle carrying portion upon which numerous tufts of bristles are mounted. The handle includes an integral hand grip portion extending from the brush bristles are uncovered and unprotected and, therefore, are exposed to dirt and direct contact with other objects.

Thus, attempts have been made to cover toothbrushes, as for example, during times of non-use or transportation or storage of a toothbrush or during the' time the toothbrushes are displayed in stores for sale. Usually the storage means comprises a container which encloses the entire toothbrush. Such containers are primarily packages for pre-sale use and, therefore, are relatively cumbersome or expensive and not made to use when the brush is transported or is simply left in a bathroom or the like for use when desired.

Thus, it would be desirable to normally cover the bristle portion of the brush, that is, the bristles, to protect them against unwanted contacts with other surfaces or accumulations of dirt from the surrounding environment and, conversely, to protect other articles from becoming damp from contact with a wet brush whenever the brush is not in use.

This invention relates to a simple, inexpensive cap which can be manually clipped over and removed from the bristle end of the brush.

SUMMARY OF INVENTION

This invention contemplates a simple, inexpensive, small size cover or cap that can be frictionally and resiliently clamped over the bristle end of a toothbrush to cover and protect the bristles whenever the brush is not in use. The cover may be sold, on the brush, within the conventional package or container in which the brush may be normally stored or kept. The cover, in general, comprises a thin wall, U-shaped member whose sides or legs are shaped to fit around the opposite sides of the bristle carrying portion of the brush. The legs frictionally and resiliently engage the side edges of the bristle carrying portion of the brush for mounting thereon. The lower edges of the cap are provided with engaging formations for better interlocking or engaging with the side edges of the bristle carrying portion. But, the lower edges are readily releasable under a small amount of manually applied force.

It is contemplated that the cap be a thin, plastic extrusion or molding which can be made so inexpensively that it can be utilized as part of the packaging of a toothbrush when it is displayed for sale in the store and, can be kept upon the brush thereafter, whenever the brush is not being used for brushing teeth.

One object of this invention is to provide an extremely inexpensive, simply applied and removed, cap for the bristles of a toothbrush which cap is shaped to fit over and embrace the side edges of the bristle portion of the brush and to interlock therewith through friction and resilient pressure.

Another object of this invention is to provide a simplified bristle cover for a toothbrush which can be inexpensively manufactured and applied upon the brush with minimal labor and, therefore, used as part of the packaging of the toothbrush when the brush is displayed within a store for sale and thereafter used by the owner of the brush for normally covering the bristles of the brush.

Still a further object of this invention is to form a bristle covering cap which resiliently clamps the bristle carrying portion of a toothbrush so that the cap is frictionally held upon the toothbrush with sufficient force to keep it from being readily dislodged, but which force can be easily overcome by a manual pressure or pulling for removing the cap.

Still a further object of this invention is to provide a simplified, inexpensive cap for a toothbrush which enables toothbrushes to be handled and sold without separate packaging, as a loose collection of toothbrushes or as a group of toothbrushes because the bristles are protected against dirt or unsanitary contacts.

These and other objects and advantages of this invention will become apparent upon reading the following description, of which the attached drawings form a part.

DESCRIPTION OF DRAWINGS

FIG. 1 is a perspective view of a conventional toothbrush with the cap positioned above the bristle portion of the brush, ready for engagement thereon.

FIG. 2 is an enlarged, perspective, partially cross-sectional view showing the cap interlocked with the bristle carrying portion of the brush.

FIG. 3 is a modified cap which utilizes a different interlocking engagement between the lower edges of the cap and the side edges of the brush.

FIG. 4 is an enlarged, partially cross-section view, illustrating the cap of FIG. 3 mounted upon the brush.

FIG. 5 is a perspective view of another modification of the cap which utilizes elongated indentations for interlocking the cap with the brush.

FIG. 6 is a cross-sectional view taken in the direction of arrows 6—6 of FIG. 5.

FIG. 7 is another modification showing the cap with end flaps and upright, spaced apart frictionally engaging indentations for clamping against the bristle portion of the brush.

FIG. 8 is a perspective, cross-sectional view taken in the direction of arrows 8—8 of FIG. 7.

FIG. 9 is a cross-sectional view taken in the direction of arrows 9—9 of FIG. 7.

FIG. 10 is a perspective view of a modified cap, similar to FIG. 1, but with end walls.

FIG. 11 is a cross-sectional view, taken on arrows 11—11 of FIG. 10.

DETAILED DESCRIPTION

FIG. 1 illustrates a conventional toothbrush 10 which has an elongated handle and bristles. The handle includes a head or bristle base portion 11, with an integral, narrowed neck portion 12 and an elongated hand grip portion 13. Rows of bristles, formed in tufts are mounted upon the upper face of the bristle base portion. The brush is illustrative of a typical toothbrush, but it should be understood that toothbrushes and their heads vary somewhat in length, width, thickness and shape, including the angularity of the sides of the bristle base portion. It is contemplated that the cap of this invention will be shaped to appropriately fit over head or the bristle end portion of the brush, regardless of the particular configuration of the head.

For illustrative purposes, the cap 20, illustrated in FIG. 1 and 2, is an elongated, U-shaped, cover member formed of a thin wall, springy plastic material. The particular plastic may be selected by those skilled in the art from commercially available plastic materials which have the ability to provide springiness or resiliency in the shape required.

The cover includes an upper base portion 21 with integral, depending sides or legs 22. The legs may be parallel or angled relative to each other depending upon the shape of the brush. The lower ends of the legs are formed with outwardly bowed strips 23, which open inwardly towards each other. These strips overlap and embrace the opposite edges of the bristle base portion of the brush as illustrated in FIG. 2.

Preferably, the space between the legs of the cover is slightly less than the width of the brush head or bristle carrying portion so that the legs must be resiliently sprung apart to engage their bowed strips over the side edges of the bristle carrying portion. Thus, the brush bristle carrying portion is clamped between the lower edges of the legs. This holds the cover in place frictionally because of the contact with the bowed lower strips on the legs, as well as by the resilient or springy pressure of the legs against the side edges of the brush.

FIGS. 3 and 4 illustrate a brush bristle base part 25 which is provided with edge grooves 26. A modified cover 27, which is U-shaped and is formed of a springy plastic material, such as that described above in connection with FIGS. 1 and 2, is shaped to fit over the bristle base portion 25. The cover 27 includes a base with integral legs 29. However, the free ends of the legs are provided with inwardly bowed strips 30, that is, bowed strips that open outwardly of each other.

The cover 27 is either slid, in a longitudinal direction over the bristle carrying portion 25 or, alternatively, is pushed downwardly upon the bristle carrying portion. In either event, the inwardly bowed strips 30 fit into, and frictionally interlock within the grooves 26. For removal, the cap can be manually slid or pulled off the brush.

FIGS. 5 and 6 illustrate a modified cover 35 whose legs 36 are provided with elongated indentations 37. These indentations extend longitudinally, that is, along the length of the cover, but not the full length. The indentations 37 may fit within corresponding grooves formed in the side edges of the brush bristle carrying portion. Alternatively, they may simply grip against the side edges of a non-grooved bristle carrying portion for frictionally engaging and holding the cap in place.

FIGS. 7, 8 and 9 illustrate a further modification. The cover 40 is provided with a base and integral legs 42 as in the case of the prior covers. However, this cover also includes a front and flap or wall 43 and a corresponding rear end wall or flap 44. The length of the cover is sufficient to completely embrace the bristles carried by the brush with the flaps located at the opposite ends of the collection of bristles.

The flaps are relatively stiff, but they may be flexing of the legs, for frictionally engaging and gripping the brush, spaces or slits 45 are provided between the side edges of the flaps and the adjacent leg portions.

The lower, free edges of the legs are provided with a number of small indentations 48, which extend upwardly, that is, from the free edges of the legs towards the base of the cover. These indentations are spaced apart so that they tightly grip the brush bristle carrying portion along the side edges for frictionally holding the cover in place.

FIGS. 10 and 11 illustrate a modified cover 50, similar to FIG. 1, but having opposite forward and rear end walls 51 and 52, respectively. The end walls are integral with the base 55 and sides or legs 56. The lower edges of the sides are formed for engaging with the head of a brush. For example, the sides may be formed with bowed lower edges 57 for receiving and gripping the opposite sides of the head of the brush. The lower edge of the rear wall 52 is provided with a notch 59 in which the handle of the brush is positioned.

The foregoing description is illustrative of operative embodiments of this invention. Therefore, it should be understood that this invention may be further developed within the scope of the following claims.

Having fully described at least one operative embodiment, I now claim:

1. A removable cover system for a toothbrush having an elongated handle with a flattened bristle portion having a rear end and a forward end with side edges, with an elongated hand grip portion integral with and extending from the forward end of the bristle portion, and the bristle portion having an upper face which numerous bristles are mounted so as to extend upwardly from said upper face, comprising:

a thin wall, elongated cover member made of a springy plastic material formed in a generally U-shaped cross-section shape with a base and integral depending legs;

the lower, free edge portions of the legs normally being located on the opposite side edges of the brush bristle portion and being formed with integral, engagement portions which are shaped to frictionally engage against their adjacent bristle portion edges and resiliently press against them, for holding the cap upon the bristle portion so that the cap extends over, and covers, the bristles and said leg engagement portions being formed by a bowed in cross-section strip formed integral with the lower free edge portions of each of the legs and including integral flaps formed on each of the opposite ends of the cover member, with the flaps being still and extending from the cap base towards the brush bristle portion for covering the opposite ends of the bristles mounted upon the bristle portion, and a gap between the side edges of said flaps and each of their adjacent cap legs so that the legs may resiliently flex independently of the flaps.

2. A removable cover system for a toothbrush as defined in claim 1, and said leg engagement portions being formed by a bowed in cross-section strip formed integral with the lower free edge portions of each of the legs.

3. A removable cover system for a toothbrush as defined in claim 2, and said strips bowing outwardly, that is, opening towards each other so that each grips and overlaps an adjacent edge of the brush bristle portion.

4. A removable cover system for a toothbrush as defined in claim 2, and said strips bowing inwardly, that is, opening in opposite directions from each other, and grooves formed along the side edges of the bristle portion and shaped to receive said bowed strips for frictionally interlocking the cap to the bristle portion.

5. A removable cover system for a toothbrush as defined in claim 2, and with the lower, free ends of the legs each having at least one elongated indentation, which extends inwardly, that is, towards the strip on the opposite leg, with said indentations pressing against the side edges of the bristle portion due to the resiliency of the legs of the cover member.

6. A removable cover system for a toothbrush as defined in claim 5, and said indentations extending longitudinally of the U-shaped member, that is, generally parallel to the free edges of the legs.

7. A removable cover system for toothbrushes as defined in claim 5, and said indentations extending upwardly, along the legs toward the base of the cover member, relative to the bristle portion, so that said indentations spring grip against the adjacent edges of the bristle portion at spaced apart locations thereof.

* * * * *

UNITED STATES PATENT AND TRADEMARK OFFICE

CERTIFICATE OF CORRECTION

PATENT NO. : 5,048,144
DATED : September 17, 1991
INVENTOR(S) : Edward A. Andrews

It is certified that error appears in the above-identified patent and that said Letters Patent is hereby corrected as shown below:

Col. 1, line 10, after "the" insert --bristle carrying portion. In ordinary usage and handling, the--.

Col. 1, Line 15: "the' " should be --the--.

Col. 3, Line 2: "FIG." should be --FIGS.--.

Col. 3, Line 60: after "be" insert --resiliently bent somewhat. In order to permit sufficient--.

Col. 4, Line 24, Claim 1: after "face" insert --upon--.

Col. 4, Line 44, Claim 1: "still" should be --stiff--.

Signed and Sealed this

Thirtieth Day of March, 1993

*Attest:*

STEPHEN G. KUNIN

*Attesting Officer*

*Acting Commissioner of Patents and Trademarks*